US012546115B2

(12) United States Patent
He

(10) Patent No.: US 12,546,115 B2
(45) Date of Patent: Feb. 10, 2026

(54) LOUVERED SHED

(71) Applicant: Jiangxi Chuangba Intelligence Household Co., Ltd, Shangrao (CN)

(72) Inventor: Youcheng He, Shangrao (CN)

(73) Assignee: JIANGXI CHUANGBA INTELLIGENCE HOUSEHOLD CO., LTD., Jiangxi (CN)

( * ) Notice: Subject to any disclaimer, the term of this patent is extended or adjusted under 35 U.S.C. 154(b) by 218 days.

(21) Appl. No.: 18/515,753

(22) Filed: Nov. 21, 2023

(65) Prior Publication Data

US 2025/0163703 A1 May 22, 2025

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04F 10/08; E04F 10/005; E04B 7/16; E04B 7/163; E04B 7/166; E04H 15/58
See application file for complete search history.

(56) References Cited

U.S. PATENT DOCUMENTS 4,527,355 A * 7/1985 Numakami ..... E04F 10/10 49/90.1
4,926,599 A * 5/1990 Scholz ..... E04F 10/10 49/90.1
2016/0177575 A1* 6/2016 Ivic ..... E04F 10/08 52/302.1
2017/0145689 A1* 5/2017 Ivic ..... E04F 10/10
2017/0152663 A1* 6/2017 Ivic ..... E06B 9/386
2019/0186149 A1* 6/2019 Ji ..... E06B 7/086
2019/0186167 A1* 6/2019 Ji ..... E04H 15/008
2019/0338528 A1* 11/2019 Torman ..... E04F 10/10
2021/0062505 A1* 3/2021 Elmore ..... E04F 10/10
2021/0214948 A1* 7/2021 Jackson ..... E04D 13/0305
2021/0262237 A1* 8/2021 Vanthournout ..... E04F 10/08
2021/0332587 A1* 10/2021 Geriavenko ..... E04F 10/10
2022/0235553 A1* 7/2022 Jackson ..... E04D 13/0305
2022/0235555 A1* 7/2022 Liang ..... H02S 20/10
2022/0341181 A1* 10/2022 Abeel ..... E04B 7/163
(Continued)

FOREIGN PATENT DOCUMENTS

AU 2019204946 A1 * 9/2019 ..... E04F 10/10
CA 3079336 A1 * 10/2021 ..... E04F 10/10
(Continued)

*Primary Examiner* — Kyle J. Walraed-Sullivan
(74) *Attorney, Agent, or Firm* — Ming Jiang; OPENPTO US LLC

(57) ABSTRACT

The present invention discloses a louvered shed, and belongs to the technical field of sunshade facilities. In addition, the louver combination herein is arranged to be replaceable, and single-layer louvers and double-layer louvers can be selected according to the use requirements. Besides, whether a center sill body is mounted between the two cross beam bodies to support the louver combination can be selected according to the size of the louvered shed, and when the center sill body is additionally mounted, the louver combination is divided into two parts to be respectively disposed on two sides of the center sill body, which can avoid the problem of deformation of the louver combination due to its excessively large size.

7 Claims, 14 Drawing Sheets

(56) References Cited

U.S. PATENT DOCUMENTS

| | | | | |
|---|---|---|---|---|
| 2023/0122435 | A1* | 4/2023 | Jackson | E04F 10/10 52/64 |
| 2023/0295932 | A1* | 9/2023 | Shan | E04H 15/34 49/74.1 |
| 2023/0392381 | A1* | 12/2023 | Brabant | E04F 10/10 |
| 2023/0417060 | A1* | 12/2023 | Hong | E04F 10/10 |
| 2024/0068241 | A1* | 2/2024 | Xu | E04F 10/10 |
| 2024/0167282 | A1* | 5/2024 | Jackson | E04D 13/0354 |
| 2024/0200337 | A1* | 6/2024 | Shen | E06B 9/28 |
| 2025/0034903 | A1* | 1/2025 | Shao | E04H 15/58 |

FOREIGN PATENT DOCUMENTS

| | | | | | |
|---|---|---|---|---|---|
| CN | 207847237 | U | * | 9/2018 | E04H 15/008 |
| CN | 111794457 | A | * | 10/2020 | E04F 10/10 |
| CN | 111946104 | A | * | 11/2020 | E04B 1/163 |
| CN | 213062656 | U | * | 4/2021 | E04F 10/10 |
| CN | 216840299 | U | * | 6/2022 | |
| CN | 218375566 | U | * | 1/2023 | E04F 10/10 |
| CN | 218522083 | U | * | 2/2023 | E04F 10/08 |
| CN | 218714478 | U | * | 3/2023 | E04F 10/10 |
| CN | 220504646 | U | * | 2/2024 | E04H 15/58 |
| CN | 117661889 | A | * | 3/2024 | E04F 10/10 |
| EP | 2853647 | A1 | * | 4/2015 | E04F 10/10 |
| FR | 2701977 | A1 | * | 9/1994 | F24F 13/15 |
| FR | 3058172 | A1 | * | 5/2018 | E06B 7/082 |
| FR | 3074509 | A1 | * | 6/2019 | E04F 10/10 |

* cited by examiner

LOUVERED SHED

TECHNICAL FIELD

The present invention belongs to the technical field of sunshade facilities, and particularly relates to a louvered shed.

BACKGROUND

Louvered sheds, which are used as sunshade facilities, are usually disposed in balconies or outdoor public areas, and are generally composed of frames, louver blades and louver driving mechanisms, for example, a top frame in an electric louvered ceiling structure of a tent is provided with several blades, long linkage strips and an electric control mechanism, the blades are rotatably mounted on the top frame, the blades are directly mated with the long linkage strips in a hinged manner or are mated with the long linkage strips in a hinged manner by means of fixing members fixed to the blades, and the electric control mechanism is configured to drive at least one long linkage strip to move, so as to control the blades to open and close.

However, in the prior art, most sunshades are fixed, the lengths and widths thereof cannot be increased and adjusted according to the use requirements, louver combinations thereof are also fixed, and the types of the louver combinations cannot be adjusted according to the use requirements, resulting in great limitations on use of the sunshades.

Therefore, a louvered shed is provided to solve the problems in the prior art, and the overall size thereof and the type of a louver combination can be changed according to the use requirements.

SUMMARY

The present invention aims to provide a louvered shed to solve the following problems put forward in the background art: in the prior art, most sunshades are fixed, the lengths and widths thereof cannot be increased and adjusted according to use requirements, louver combinations thereof are also fixed, and the types of the louver combinations cannot be adjusted according to the use requirements, resulting in great limitations on use of the sunshades.

In order to achieve the above purpose, the following technical solution is adopted for the present invention:

the louvered shed comprises stand column combinations, side beam combinations, cross beam combinations and a louver combination, where there are two symmetrically provided side beam combinations and two symmetrically provided cross beam combinations, and the two side beam combinations and the two cross beam combinations are provided vertically; connection assemblies are provided both between the side beam combinations and the stand column combinations and between the cross beam combinations and the stand column combinations, and the side beam combinations and the cross beam combinations are connected to the tops of the stand column combinations by means of the connection assemblies; the louver combination is mounted among the two side beam combinations and the two cross beam combinations, the louver combination is arranged to be replaceable, and the louver combination is also mounted with a driving assembly in a mated manner for driving the louver combination to open and close; and the stand column combinations, the side beam combinations and the cross beam combinations are all arranged to be capable of being assembled.

Preferably, the side beam combination comprises a side beam body, an upper portion of a side edge of the side beam body is provided with a louver fixing groove, a surface of a side edge of the louver fixing groove is provided with a plurality of Z-shaped mounting grooves in a length direction in a linear array manner, a lower portion of the side edge of the louver fixing groove is provided with a snap-fitting groove, the bottom of the side beam body extends in a width direction to form a clamping plate, and a surface of the clamping plate is provided with a semi-circular buckle groove.

Preferably, the cross beam combination comprises a cross beam body, an upper portion of a side edge of the cross beam body is provided with a louver fixing groove identical to that of the side beam body, a lower portion of a side edge of the louver fixing groove is provided with a snap-fitting groove, the bottom of the cross beam body extends in a width direction to form a clamping plate identical to that of the side beam body, and a surface of the clamping plate is provided with a semi-circular buckle groove.

Preferably, the louvered shed further comprises a water channel assembly mounted on the cross beam bodies and the side beam bodies, where the water channel assembly comprises first water channel bodies and second water channel bodies, the first water channel bodies and the second water channel bodies are provided in recessed shapes, the shape of one side edge of the first water channel body and the second water channel body is mated with the shape of the snap-fitting groove, the clamping plate and the buckle groove, and an upper portion of the other side of the first water channel body and the second water channel body is provided with a light strip mounting groove.

Preferably, the louver combination comprises several double-layer louvers provided between the two side beam bodies, two ends of the double-layer louver are fixedly connected to louver sealing plates by means of screws, surfaces of the two louver sealing plates are provided with rotating shaft holes and pulley fixing holes, a louver transmission shaft is fixedly connected in an inner cavity of the rotating shaft hole, a louver fixing shaft pulley is fixedly connected in an inner cavity of the pulley fixing hole, and a plurality of the louver fixing shaft pulleys are snap-fitted in inner cavities of their corresponding Z-shaped mounting grooves.

Preferably, the louver combination comprises single-layer louvers provided between the two side beam bodies, two ends of the single-layer louver are provided with louver clips, the two ends of the single-layer louver are snap-fitted with the louver clips, inner sides of the side beam bodies are provided with second threaded holes, and the louver clips are in threaded connection with the second threaded holes by means of screws, such that the louver clips are rotatably connected to the side beam bodies.

Preferably, the driving assembly comprises first linkage rods, the first linkage rod is provided with a plurality of connection holes in a length direction in a linear array manner, and the plurality of connection holes are provided in correspondence to the plurality of louver transmission shafts; and a transmission sheet is mounted on the surface of the louver sealing plate, a surface of the transmission sheet is in transmission connection with a driving sheet, a gearbox is mounted on a surface of the side beam body, and the driving sheet is rotatably connected to the gearbox.

Preferably, the driving assembly comprises a center sill body fixedly mounted between the two cross beam bodies, two sides of the center sill body are provided with second linkage rods, the first louver is a fixed louver, the clips corresponding to the fixed louver are fixed louver clips, the bottom of the fixed louver clip is provided with a connection column, one end of the second linkage rod is connected to a surface of the connection column, two ends of the center sill body are provided with first positioning holes, and second positioning holes are provided in surfaces of the cross beam bodies and located at positions corresponding to the first positioning holes.

Preferably, the stand column combination comprises a stand column body, the stand column body is arranged in a hollow square pipe shape, a surface of the top end thereof is cut downwards to form a mounting opening, and each of the planes on two sides of the mounting opening is provided with three mounting holes in a linear vertical array; a stand column base plate is provided below the stand column body, the stand column base plate is arranged in a square shape, a surface thereof is subjected to laser cutting and bent to be provided with four connection plates in a circular central array, and a surface of the connection plate is provided with a first threaded hole; and first through holes are provided in four outer surfaces of a lower portion of the stand column body at positions corresponding to the first threaded holes, positioning wires are provided outside the stand column body, and one end of the positioning wire penetrates through the first through hole and extends into an inner cavity of the stand column body to be in threaded connection with an inner wall of the first threaded hole.

Preferably, the connection assembly comprises a stand column connector provided at the top end of the stand column body, the shape of the stand column connector is identical to that of the top end of the stand column body, and second through holes are formed in the positions of two sides of the stand column connector corresponding to the mounting holes on the two sides of the stand column body; two ends of the cross beam body and the side beam body are provided with connection blocks, the connection blocks are of hollowed-out structures, surfaces of the connection blocks are mated with inner cavities of the cross beam bodies and the side beam bodies, top ends and side surfaces of the connection blocks are provided with limiting holes, and third through holes are formed in the positions of the connection blocks corresponding to the second through holes; fourth through holes are formed in the positions of top ends and side portions of the side beam bodies and the cross beam bodies corresponding to the limiting holes; bolts and nuts are further comprised, and the connection blocks are bolted and fixed to the top ends of the stand column bodies by means of the bolts and the nuts; and stand column cover plates connected to the tops of the side beam bodies and the cross beam bodies are further comprised.

The present invention has the technical effects and advantages as follows: compared with the prior art, the louvered shed provided herein has the advantages as follows:

with regard to the louvered shed disclosed herein, the use lengths of the cross beam bodies, the side beam bodies and the stand column bodies can be assembled according to use requirements, thereby achieving the purpose of adjusting the use size of the louvered shed; in addition, the louver combination herein is arranged to be replaceable, and the single-layer louvers and the double-layer louvers can be selected according to the use requirements; besides, whether the center sill body is mounted between the two cross beam bodies to support the louver combination can be selected according to the size of the louvered shed, and when the center sill body is additionally mounted, the louver combination is divided into two parts to be respectively disposed on two sides of the center sill body, which can avoid the problem of deformation of the louver combination due to its excessively large size; and by means of the arrangement of the device herein, a user can change the overall size of the louvered shed and the type of the louver combination according to the use requirements.

Figure 1:
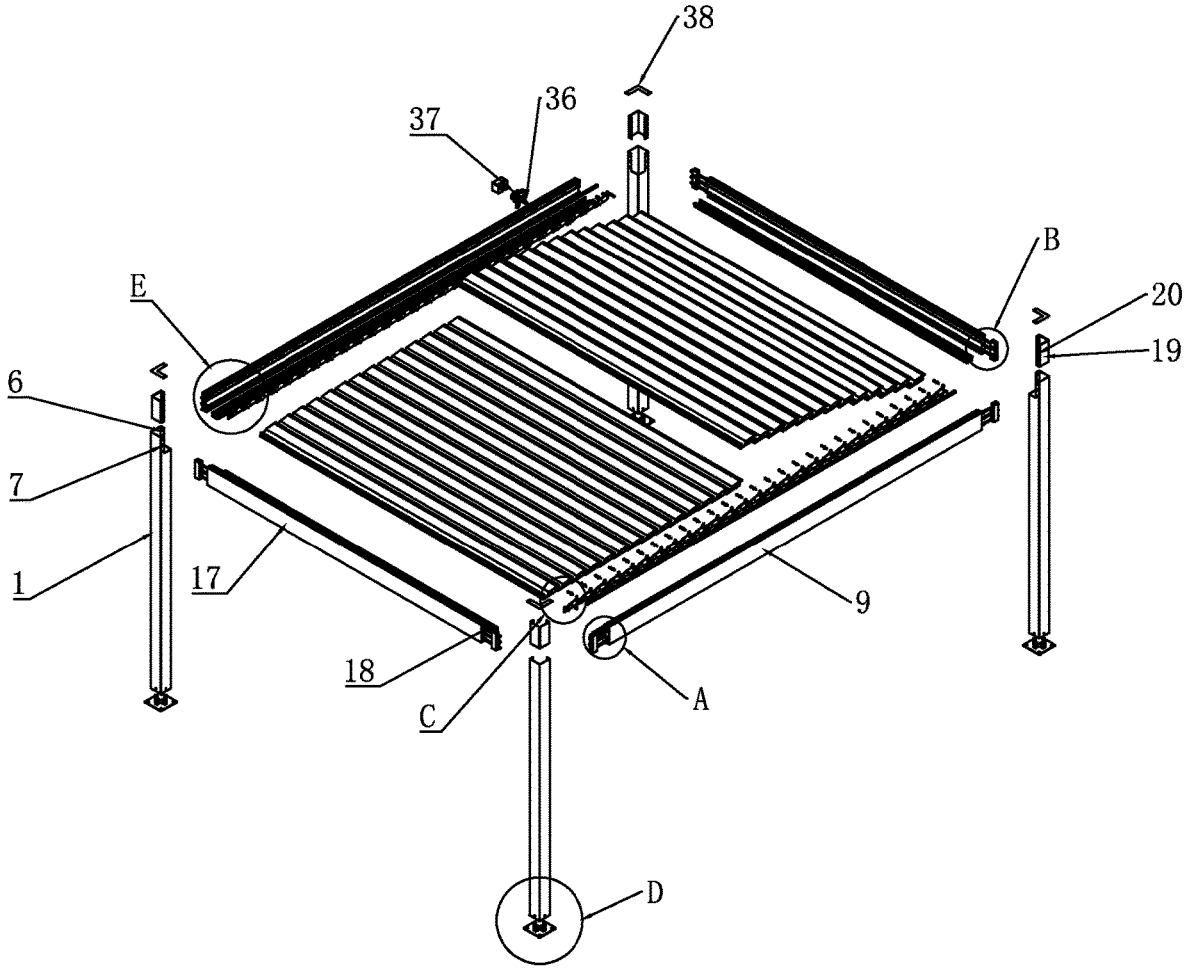
FIG. 1 is a structure diagram of a louvered shed in Embodiment 1 of the present invention.
Figure 2:
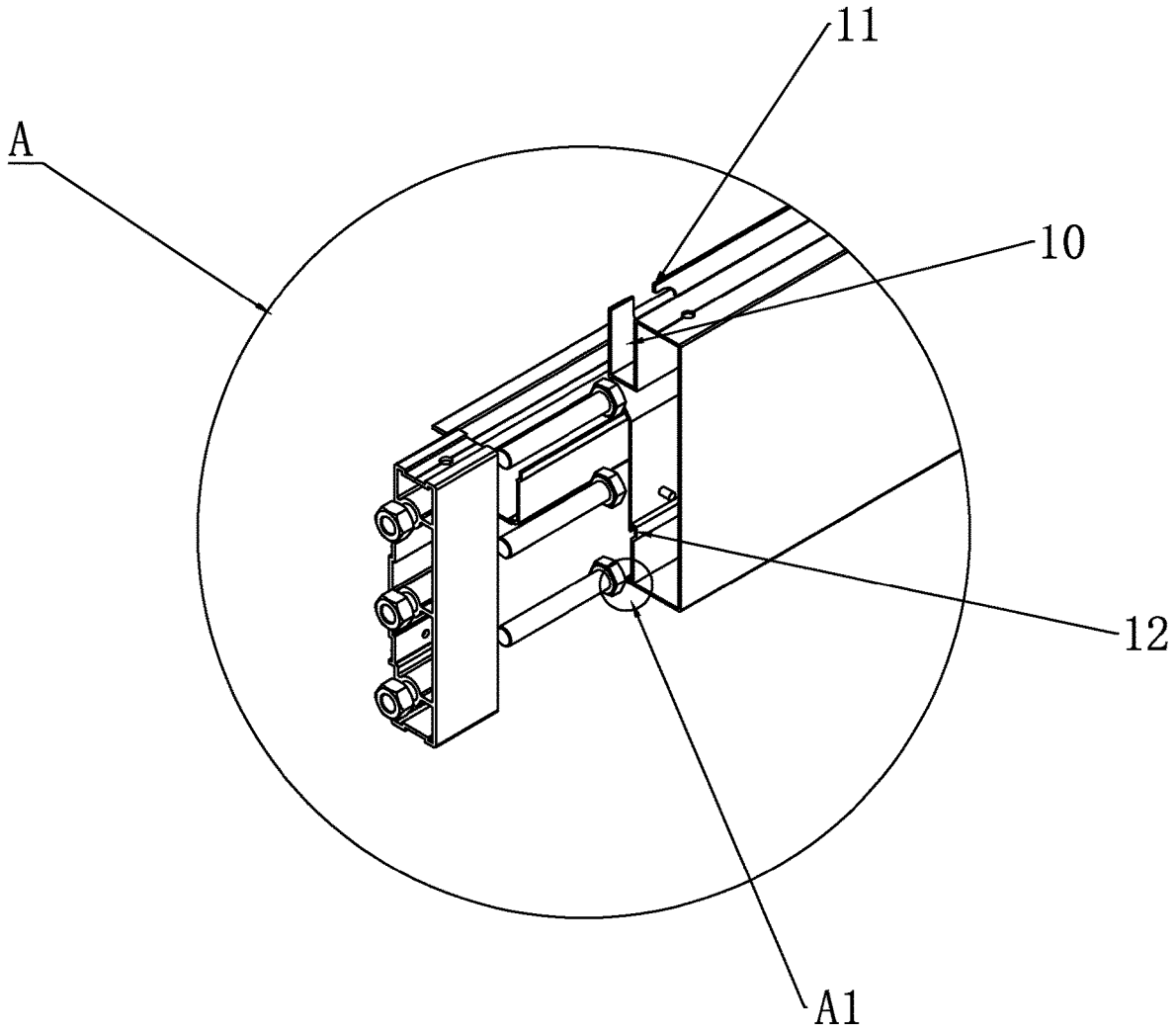
FIG. 2 is an enlarged view at A in FIG. 1 of the present invention.
Figure 3:
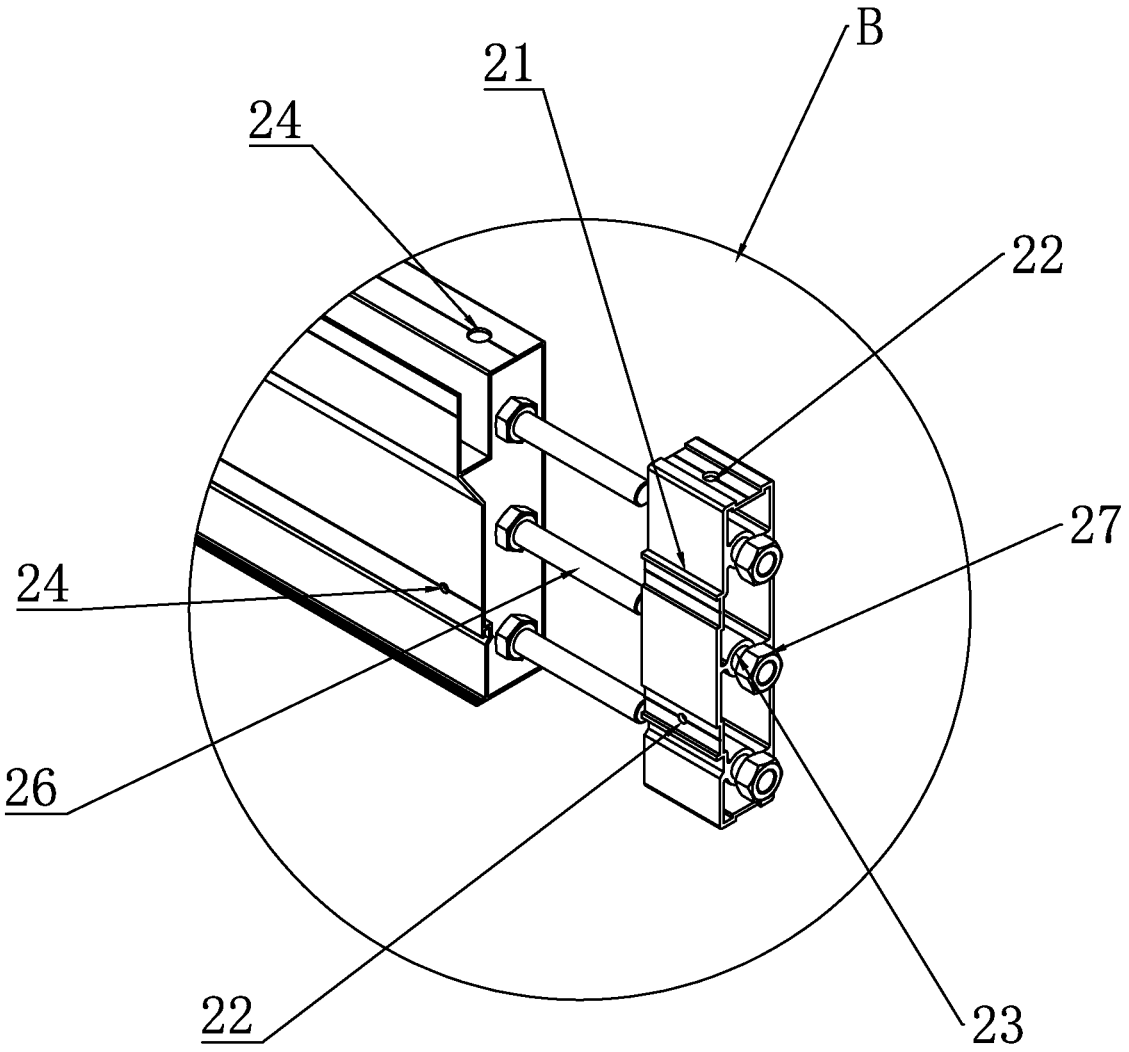
FIG. 3 is an enlarged view at B in FIG. 1 of the present invention.
Figure 4:
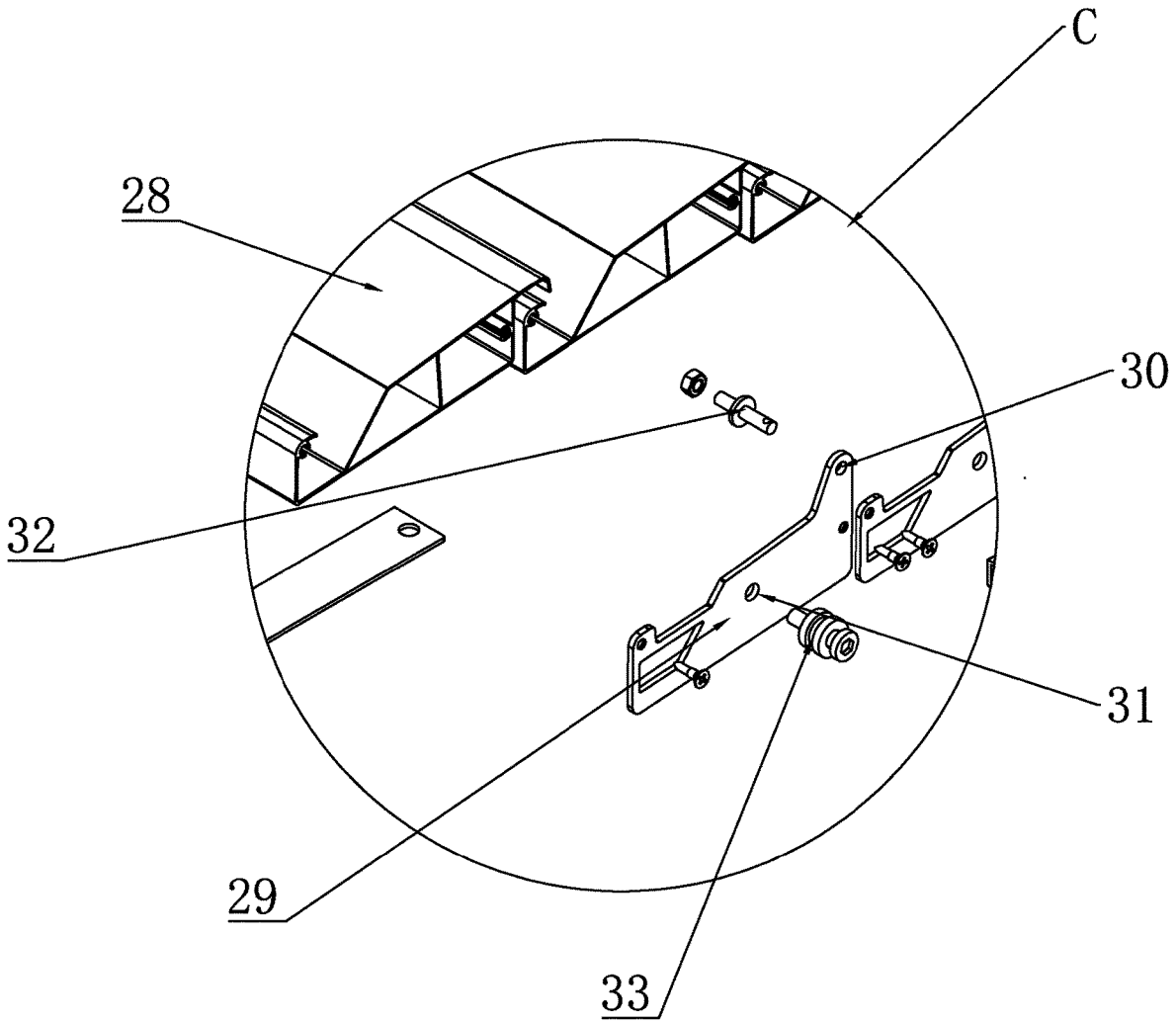
FIG. 4 is an enlarged view at C in FIG. 1 of the present invention.
Figure 5:
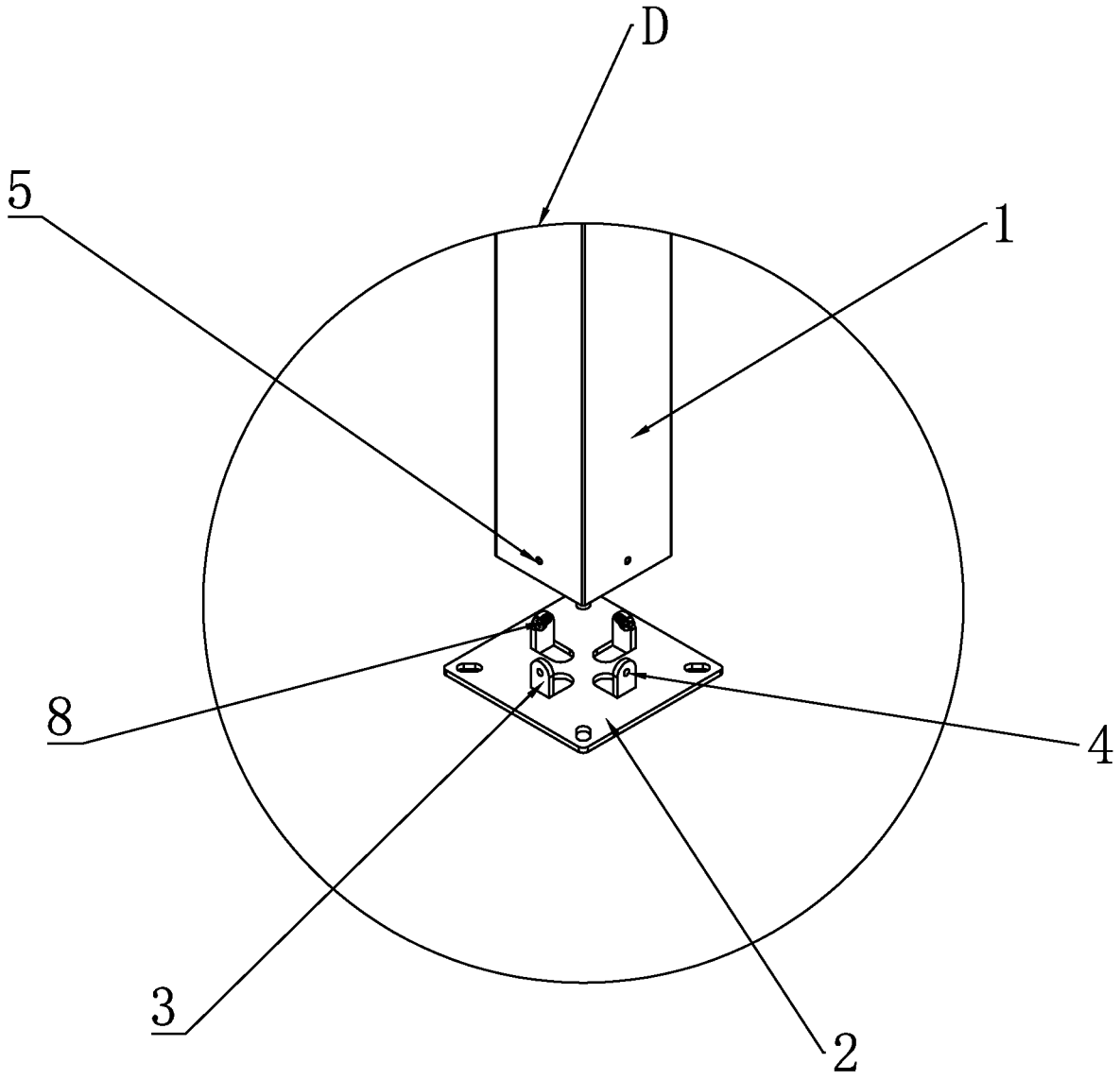
FIG. 5 is an enlarged view at D in FIG. 1 of the present invention.
Figure 6:
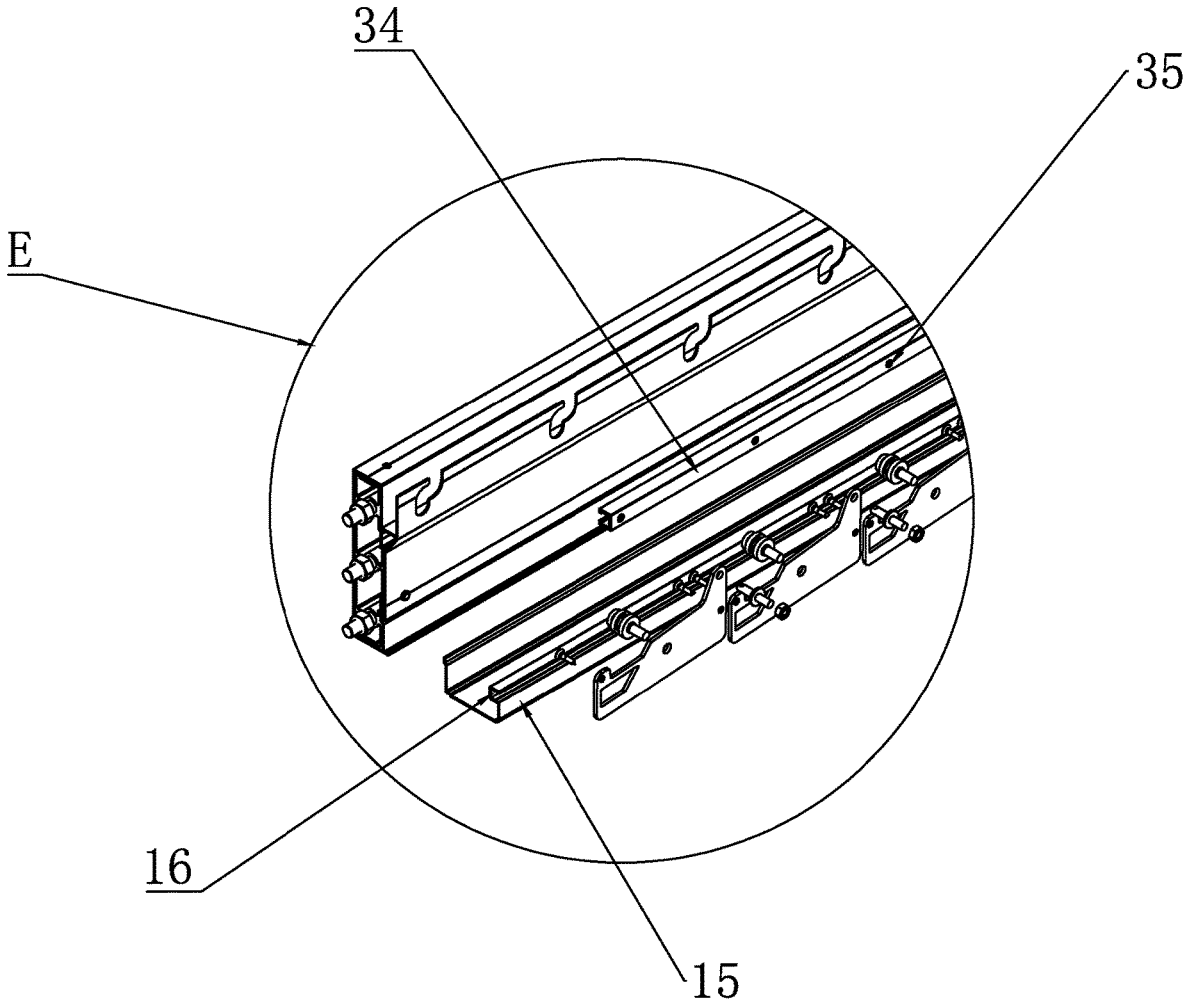
FIG. 6 is an enlarged view at E in FIG. 1 of the present invention.
Figure 7:
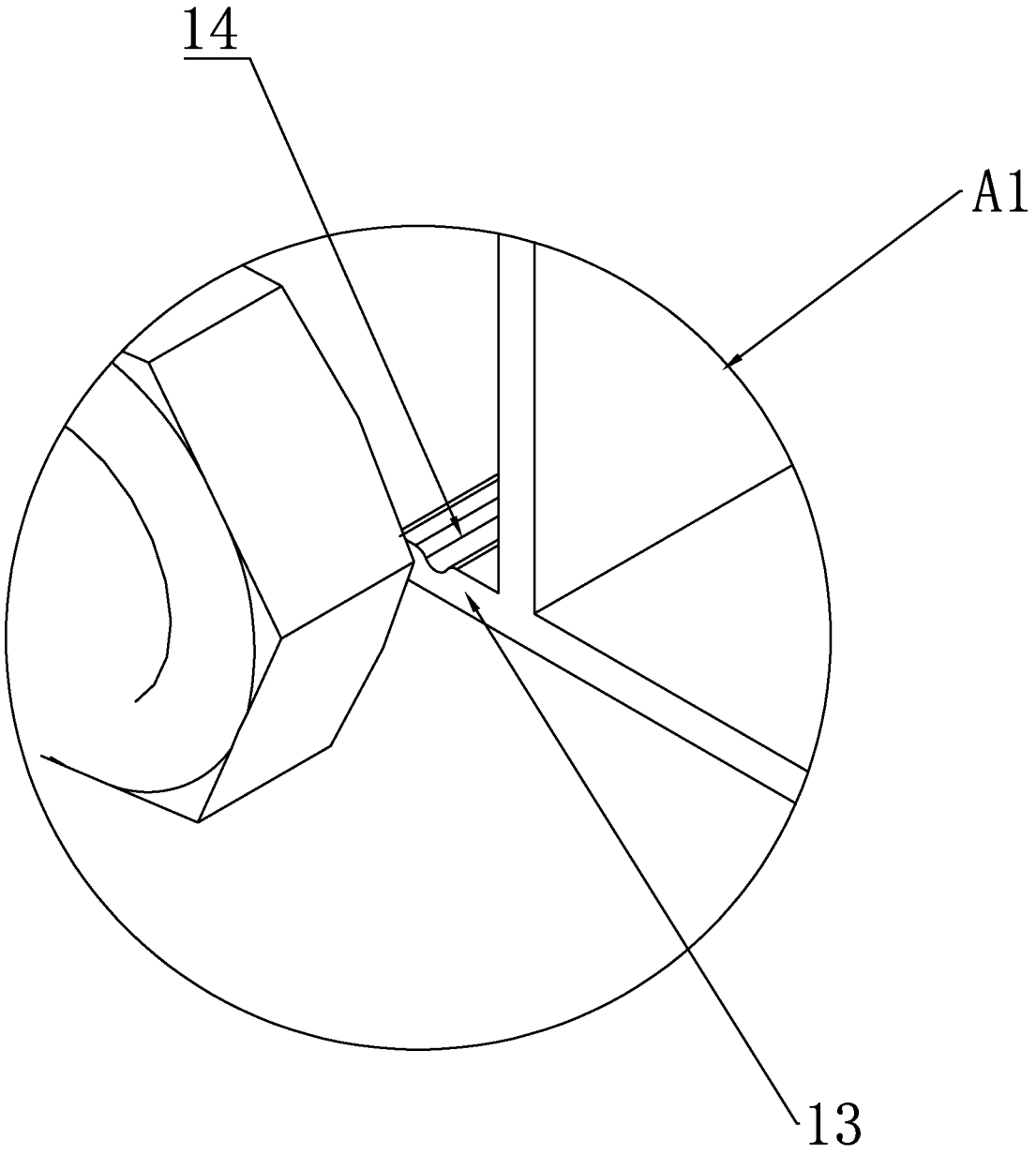
FIG. 7 is an enlarged view at A1 in FIG. 2 of the present invention.
Figure 8:
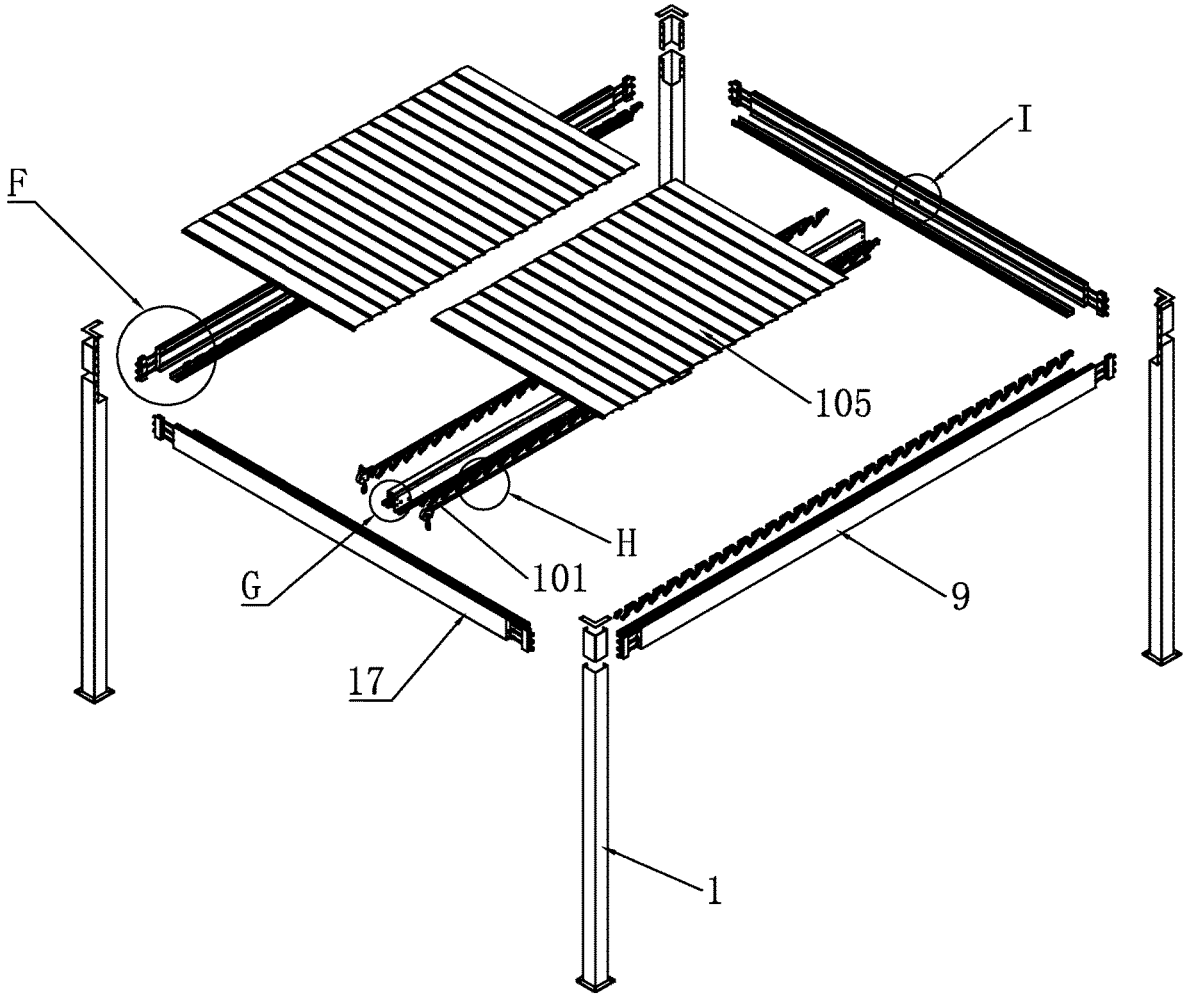
FIG. 8 is a structure diagram of a louvered shed in Embodiment 2 of the present invention.
Figure 9:
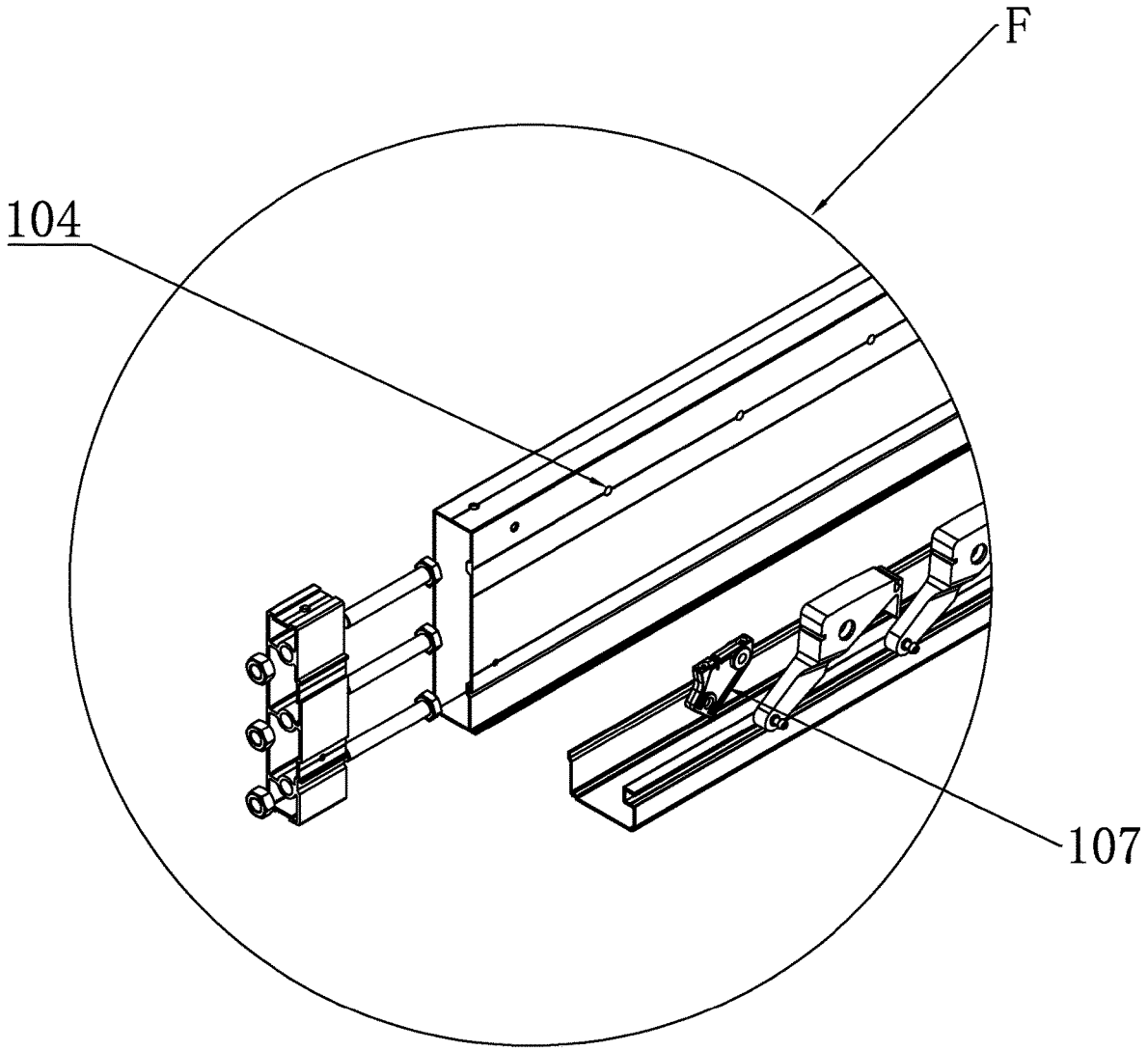
FIG. 9 is an enlarged view at F in FIG. 8 of the present invention.
Figure 10:
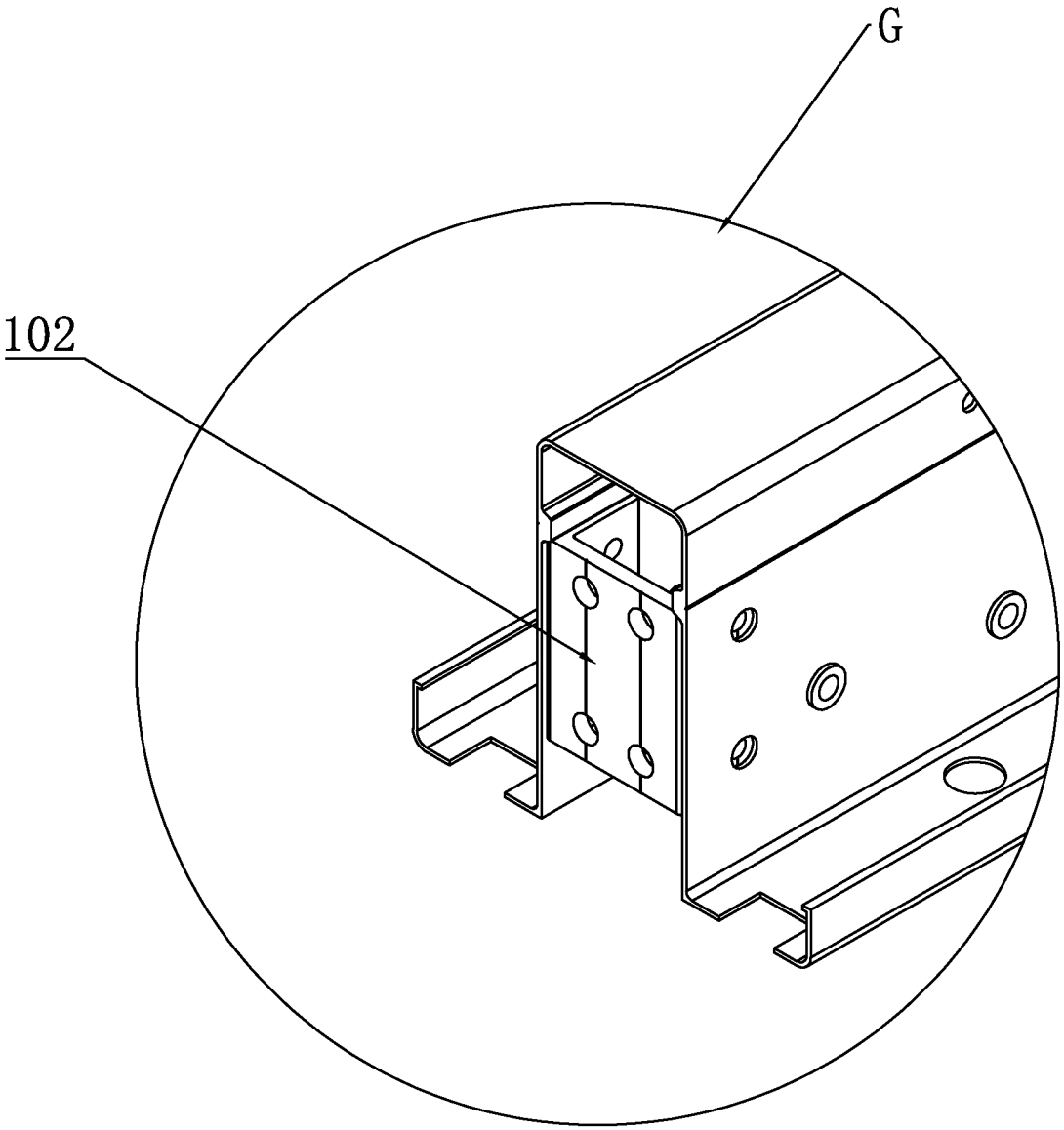
FIG. 10 is an enlarged view at G in FIG. 8 of the present invention.
Figure 11:
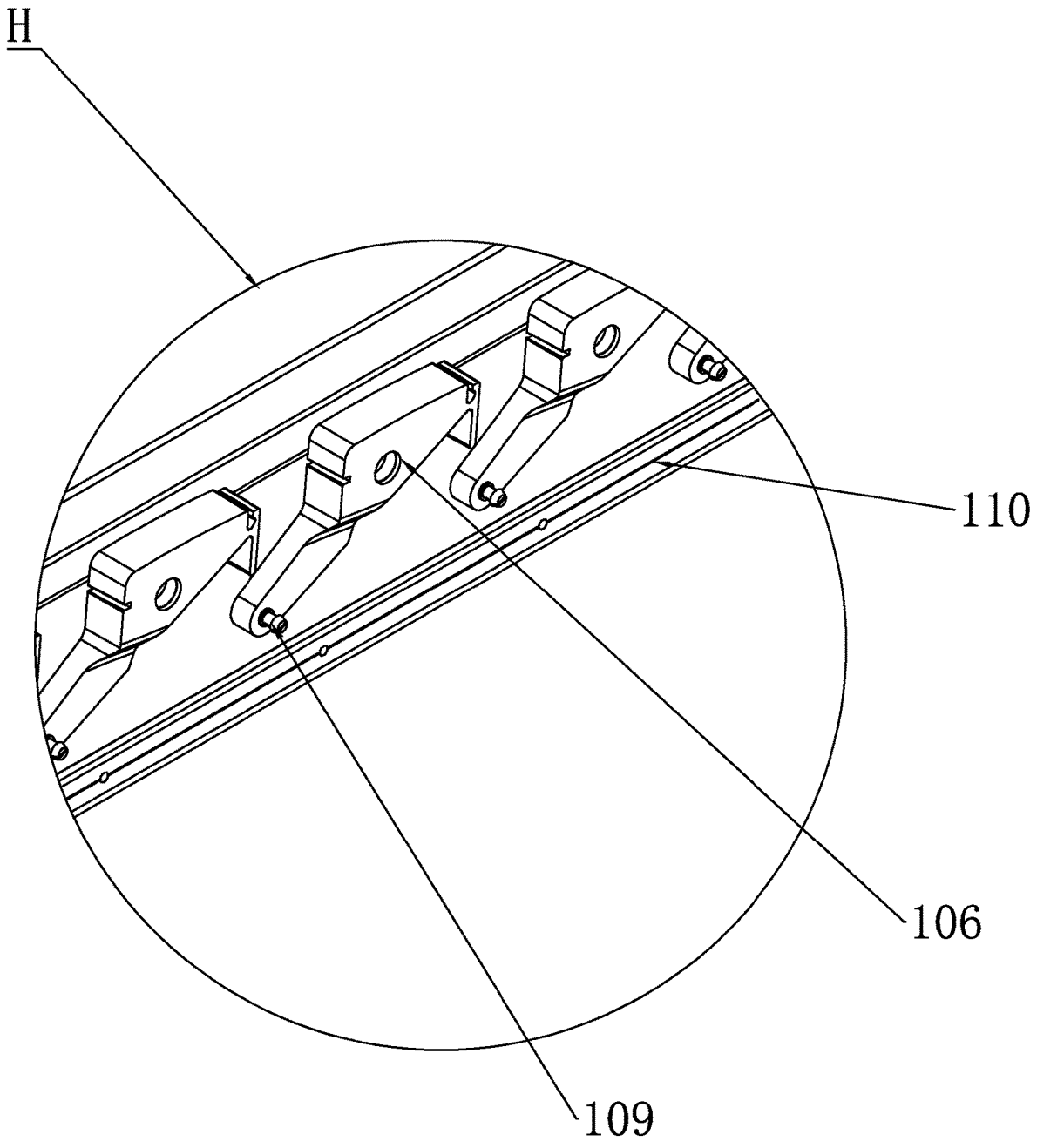
FIG. 11 is an enlarged view at H in FIG. 8 of the present invention.
Figure 12:
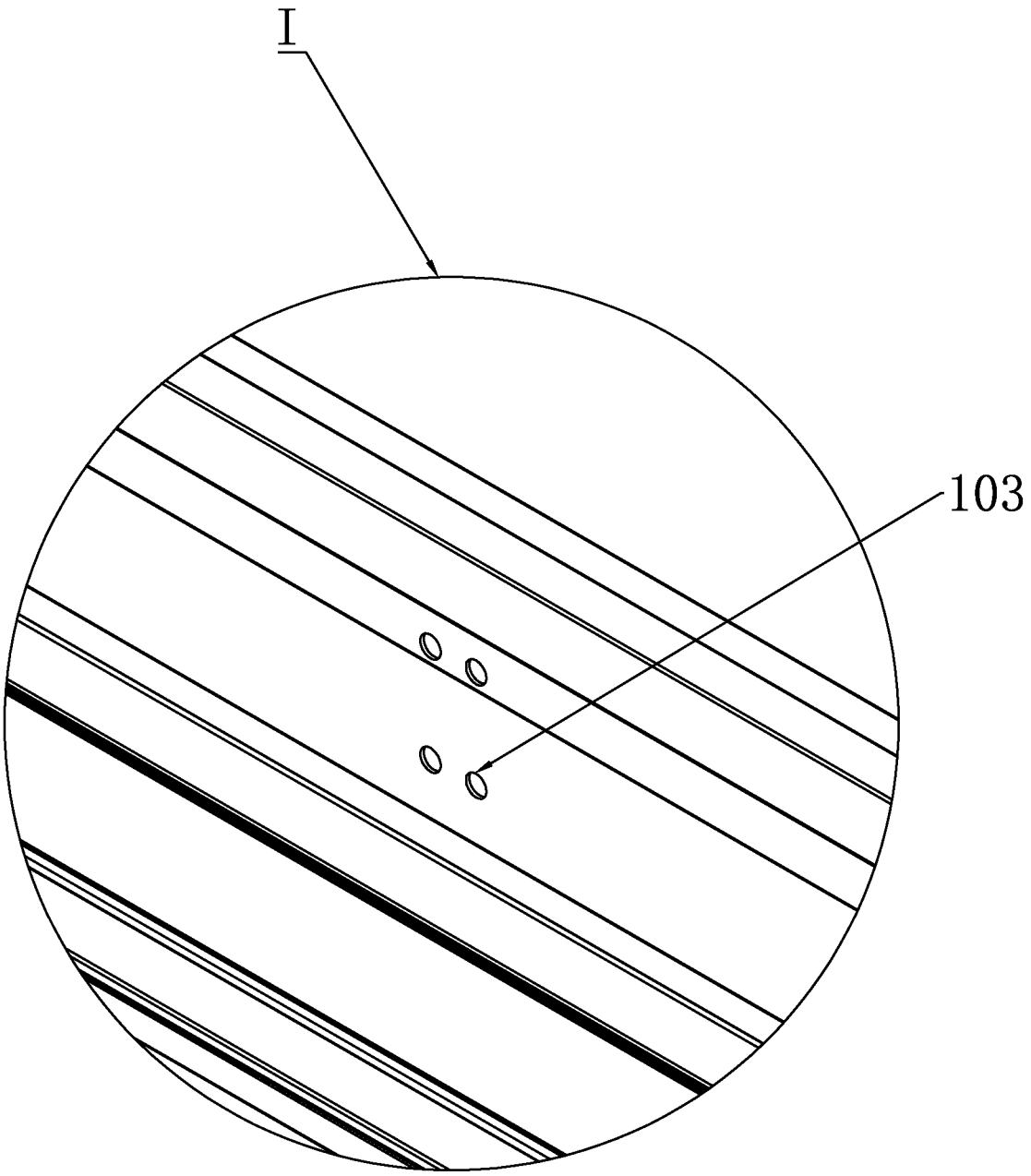
FIG. 12 is an enlarged view at I in FIG. 8 of the present invention.

In the figures: 1, stand column body; 2, stand column base plate; 3, connection plate; 4, first threaded hole; 5, first through hole; 6, mounting opening; 7, mounting hole; 8, positioning wire; 9, side beam body; 10, louver fixing groove; 11, Z-shaped mounting groove; 12, snap-fitting groove; 13, clamping plate; 14, buckle groove; 15, first water channel body; 16, light strip mounting groove; 17, cross beam body; 18, second water channel body; 19, stand column connector; 20, second through hole; 21, connection block; 22, limiting hole; 23, third through hole; 24, fourth through hole; 26, bolt; 27, nut; 28, double-layer louver; 29, louver sealing plate; 30, rotating shaft hole; 31, pulley fixing hole; 32, louver transmission shaft; 33, louver fixing shaft pulley; 34, first linkage rod; 35, connection hole; 36, driving sheet; 37, gearbox; 38, stand column cover plate; 101, center sill body; 102, first positioning hole; 103, second positioning hole; 104, second threaded hole; 105, single-layer louver; 106, louver clip; 107, fixed louver clip; 109, connection column; and 110, second linkage rod.

DETAILED DESCRIPTION

The technical solutions in embodiments of the present invention will be described clearly and completely below in conjunction with the accompanying drawings in the embodiments of the present invention. Obviously, the described embodiments are only a part of embodiments of the present invention, but not all of them. The specific embodiments described herein are only intended to explain the present invention, but are not intended to limit the present invention. On the basis of the embodiments of the present invention, all other embodiments obtained by those of ordinary skill in the art without involving any inventive effort should fall within the scope of protection of the present invention.

Embodiment 1

Referring to FIG. 1-FIG. 7, the present invention discloses a louvered shed, including stand column combinations, side beam combinations, cross beam combinations and a louver combination, where there are two symmetrically provided side beam combinations and two symmetrically provided cross beam combinations, and the two side beam combinations and the two cross beam combinations are provided vertically; connection assemblies are provided both between the side beam combinations and the stand column combinations and between the cross beam combinations and the stand column combinations, and the side beam combinations and the cross beam combinations are connected to the tops of the stand column combinations by means of the connection assemblies; the louver combination is mounted among the two side beam combinations and the two cross beam combinations, the louver combination is arranged to be replaceable, and the louver combination is also provided with a driving assembly in a mated manner for driving the louver combination to open and close; and the stand column combinations, the side beam combinations and the cross beam combinations are capable of being assembled.

Figure 13:
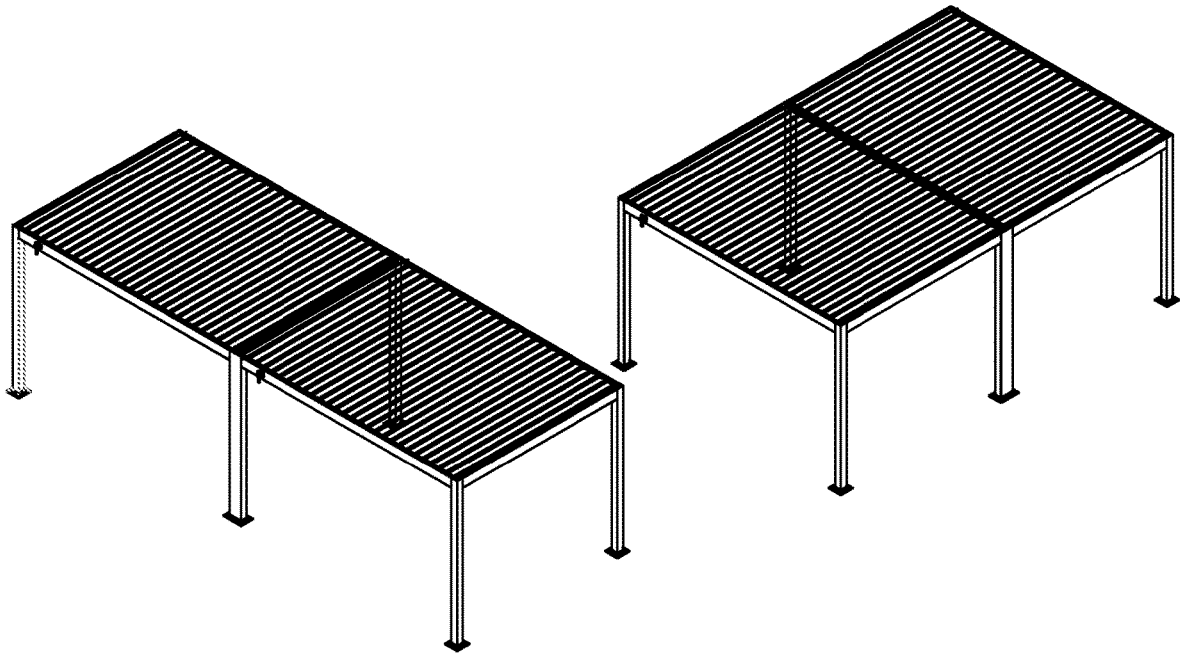
FIG. 13 is a structure diagram of the louvered shed in Embodiment 1 or Embodiment 2 of the present invention when being assembled for use.

In this embodiment, there are four stand column combinations provided as supports, and the bottoms thereof are used to be connected to the ground or mounting bases; the cross beam combinations and the side beam combinations are mounted together with the stand column combinations by means of the connection assemblies, and the louver combination is mounted and supported by means of the cross beam combinations and the side beam combinations; in addition, the driving assembly is mounted and can be used to drive the louver combination to open and close, thereby adjusting the use angle of the louvers. It should be noted that the stand column combinations, the side beam combinations and the cross beam combinations disclosed in this embodiment are arranged to be capable of being assembled and can be assembled by means of assembly members so as to adjust the size of the louvered shed. As shown in FIG. 13, the louvered shed in this embodiment can be assembled transversely or longitudinally, thereby adjusting the size and state in use. Besides, various sunshade systems can be mounted on side surfaces of the louvered shed, including but not limited to windproof roller shutters, glass sliding doors, louvered sliding doors, or cloth curtains.

Specifically, the side beam combination above includes a side beam body 9, an upper portion of a side edge of the side beam body 9 is provided with a louver fixing groove 10, a surface of a side edge of the louver fixing groove 10 is provided with a plurality of Z-shaped mounting grooves 11 in a length direction in a linear array manner, a lower portion of the side edge of the louver fixing groove 10 is provided with a snap-fitting groove 12, the bottom of the side beam body 9 extends in a width direction to form a clamping plate 13, and a surface of the clamping plate 13 is provided with a semi-circular buckle groove 14.

Further, the cross beam combination above includes a cross beam body 17, an upper portion of a side edge of the cross beam body 17 is provided with a louver fixing groove 10 identical to that of the side beam body 9, a lower portion of a side edge of the louver fixing groove 10 is provided with a snap-fitting groove 12, the bottom of the cross beam body 17 extends in a width direction to form a clamping plate 13 identical to that of the side beam body 9, and a surface of the clamping plate 13 is provided with a semi-circular buckle groove 14.

Further, the louvered shed further includes a water channel assembly mounted on the cross beam bodies 17 and the side beam bodies 9, where the water channel assembly includes first water channel bodies 15 and second water channel bodies 18, the first water channel bodies 15 and the second water channel bodies 18 are provided in recessed shapes, the shape of one side edge of the first water channel body 15 and the second water channel body 18 is mated with the shape of the snap-fitting groove 12, the clamping plate 13 and the buckle groove 14, an upper portion of the other side of the first water channel body 15 and the second water channel body 18 is provided with a light strip mounting groove 16, and an illumination light strip is bonded inside the light strip mounting groove 16.

In this embodiment, the water channel assembly is provided on the cross beam combinations and the side beam combinations and is configured to drain water on rainy days; the first water channel bodies 15 are mounted on the side beam bodies 9, the second water channel bodies 18 are mounted on the cross beam bodies 17, the first water channel bodies 15 and the second water channel bodies 18 in this embodiment are provided in recessed shapes, the shape of one side edge of the first water channel body and the second water channel body is mated with the shape of the snap-fitting groove 12, the clamping plate 13 and the buckle groove 14, and the upper portion of the other side of the first water channel body 15 and the second water channel body 18 is provided with the light strip mounting groove 16; and the first water channel bodies 15 are snap-fitted on the side beam bodies 9 by means of the snap-fitting grooves 12, the second water channel bodies 18 are snap-fitted on the cross beam bodies 17 by means of the snap-fitting grooves 12, then the first water channel bodies 15 are buckled on the side beam bodies 9 by means of the buckle grooves 14, and the second water channel bodies 18 are buckled on the cross beam bodies 17 by means of the buckle grooves 14.

Preferably, the louver combination includes several double-layer louvers 28 provided between the two side beam bodies 9, two ends of the double-layer louver 28 are fixedly connected to louver sealing plates 29 by means of screws, surfaces of the two louver sealing plates 29 are provided with rotating shaft holes 30 and pulley fixing holes 31, a louver transmission shaft 32 is fixedly connected in an inner cavity of the rotating shaft hole 30, a louver fixing shaft pulley 33 is fixedly connected in an inner cavity of the pulley fixing hole 31, and a plurality of the louver fixing shaft pulleys 33 are snap-fitted in inner cavities of their corresponding Z-shaped mounting grooves 11.

It should be noted that the driving assembly includes first linkage rods 34, the first linkage rod 34 is provided with a plurality of connection holes 35 in a length direction in a linear array manner, and the plurality of connection holes 35 are provided in correspondence to the plurality of louver transmission shafts 32; and a transmission sheet is mounted on the surface of the louver sealing plate 29, a surface of the transmission sheet is in transmission connection with a driving sheet 36, a gearbox 37 is mounted on a surface of the side beam body 9, and the driving sheet 36 is rotatably connected to the gearbox 37.

In this embodiment, the driving assembly is provided so as to provide power for the louver combination and is configured to adjust the use angle of the louver combination. It should be noted that a transmission louver in this embodiment is the third double-layer louver 28, the third double-layer louver 28 can be driven by the driving assembly to rotate so as to drive another double-layer louvers 28 to rotate synchronously, thereby achieving the purpose of adjusting the use angle of the double-layer louvers 28. Specifically, when the angle of the louver combination needs to be adjusted, a driving motor can be turned on by means of an external controller, an output shaft of the driving motor can drive, by means of the gearbox 37, the driving sheet 36 to move, and then the louver combination is driven by means of the transmission sheets and the louver sealing plates 29 to perform angle adjustment. Electric driving is adopted in this embodiment, and in other embodiments, the driving sheet 36 can be driven in a manual shaking manner to move, so as to achieve the purpose of manually adjusting the use angle of the louver combination.

In addition, the stand column combination above includes a stand column body 1, the stand column body 1 is arranged in a hollow square pipe shape, a surface of the top end thereof is cut downwards to form a mounting opening 6, and each of the planes on two sides of the mounting opening 6 is provided with three mounting holes 7 in a linear vertical array; a stand column base plate 2 is provided below the stand column body 1, the stand column base plate 2 is arranged in a square shape, a surface thereof is subjected to laser cutting and bent to be provided with four connection plates 3 in a circular central array, and a surface of the connection plate 3 is provided with a first threaded hole 4; and first through holes 5 are provided in four outer surfaces of a lower portion of the stand column body 1 at positions corresponding to the first threaded holes 4, positioning wires 8 are provided outside the stand column body 1, and one end of the positioning wire 8 penetrates through the first through hole 5 and extends into an inner cavity of the stand column body 1 to be in threaded connection with an inner wall of the first threaded hole 4.

Figure 14:
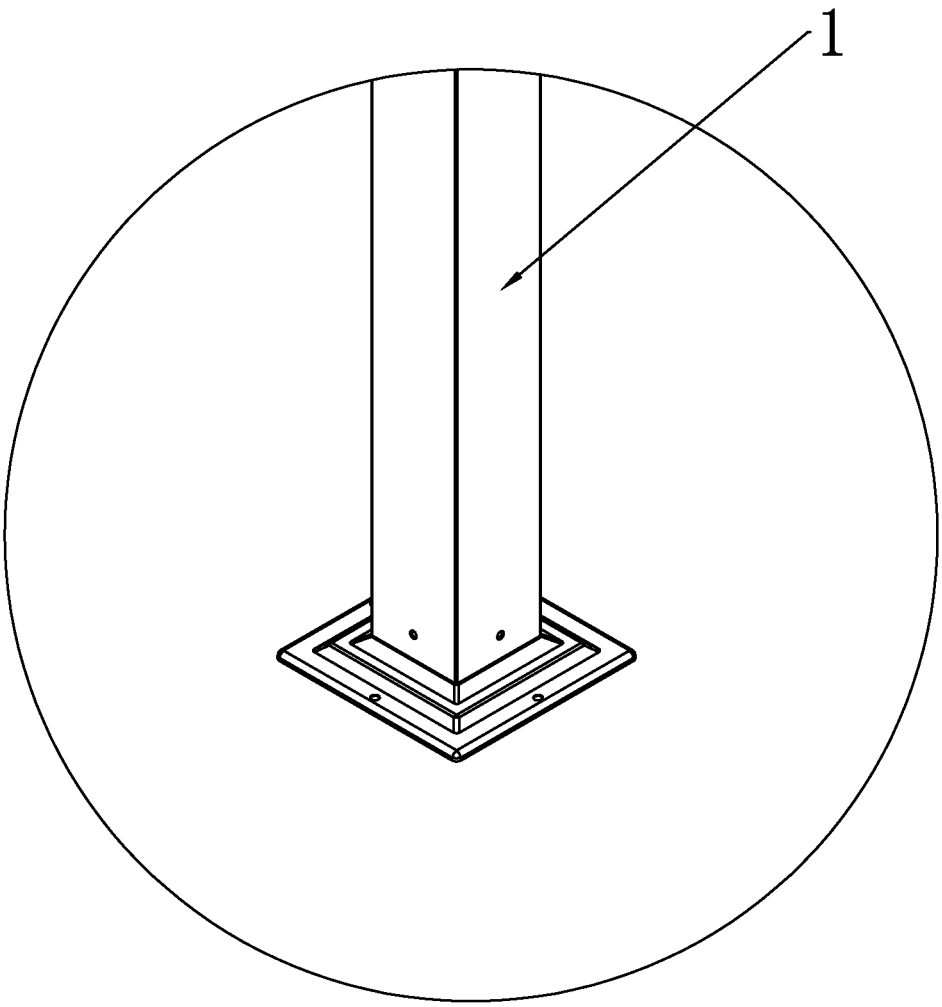
FIG. 14 is a structure diagram of a stand column base plate in Embodiment 1 or Embodiment 2 of the present invention in another form.

Specifically, when each stand column body 1 is mounted on the ground or the mounting base, firstly, a user can place the bottom of the stand column base plate 2 on the mounting base and then tighten and fix the stand column base plate by means of screws, and then the user can insert the bottom of the stand column body 1 on the connection plates 3 and tighten the positioning wires 8 to lock and fix the stand column body 1 and the connection plates 3 together, thereby mounting and fixing the stand column body 1 in the use position. As shown in FIG. 14, in other embodiments, the stand column body 1 can be directly fixed to the mounting base by means of other connection members, there are many mounting manners and states, and all that is needed is to achieve the mounting and fixing effect, which will not be repeated here.

In order to mount the cross beam combinations and the side beam combinations on the stand column combinations, the connection assemblies are provided at the junctions thereof. Specifically, the connection assembly includes a stand column connector 19 provided at the top end of the stand column body 1, the shape of the stand column connector 19 is identical to that of the top end of the stand column body 1, and second through holes 20 are formed in the positions of two sides of the stand column connector 19 corresponding to the mounting holes 7 on the two sides of the stand column body 1; two ends of the cross beam body 17 and the side beam body 9 are provided with connection blocks 21, the connection blocks 21 are of hollowed-out structures, surfaces of the connection blocks 21 are mated with inner cavities of the cross beam bodies 17 and the side beam bodies 9, top ends and side surfaces of the connection blocks 21 are provided with limiting holes 22, and third through holes 23 are formed in the positions of the connection blocks 21 corresponding to the second through holes 20; and in this embodiment, the connection blocks 21 and the side beam bodies 9 and the cross beam bodies 17 adopt the split design and are fixed in a bolted manner, and in other embodiments, the connection blocks 21 can also be mounted on the side beam bodies 9 and the cross beam bodies 17 by means of the integrated design. Fourth through holes 24 are formed in the positions of top ends and side portions of the side beam bodies 9 and the cross beam bodies 17 corresponding to the limiting holes 22; bolts 26 and nuts 27 are further included, and the connection blocks 21 are bolted and fixed to the top ends of the stand column bodies 1 by means of the bolts 26 and the nuts 27; and stand column cover plates 38 connected to the tops of the side beam bodies 9 and the cross beam bodies 17 are further included.

When the cross beam combinations and the side beam combinations are mounted on the stand column bodies 1, the user can limit the connection blocks 21 in the inner cavities of the side beam bodies 9 or the cross beam bodies 17 by passing the screws through the fourth through holes 24 to be in threaded connection in threaded rivets. Then the bolts 26 pass through the three third through holes 23 in each connection block 21, and the nuts 27 fix the bolts 26 in the three third through holes 23 in the connection block 21; the connection blocks 21 connected by means of the bolts 26 are placed into the inner cavities of the cross beam bodies 17 and the side beam bodies 9, the screws pass through the fourth through holes 24 in the cross beam bodies 17 and the side beam bodies 9 to connect the connection blocks 21 into the inner cavities of the cross beam bodies 17 and the side beam bodies 9 in a threaded manner. With regard to the cross beam bodies 17 and the side beam bodies 9 which are connected, the bolts 26 pass through the mounting holes 7 on two sides of the stand column bodies 1 and the second through holes 20 on two sides of the stand column connectors 19, then the side beam bodies 9 and the cross beam bodies 17 are fixedly connected to the stand column bodies 1 by means of the nuts 27, and the four stand column bodies 1 are connected with the same method.

Embodiment 2

Referring to FIG. 8-FIG. 12, the present invention discloses a louvered shed, including stand column combinations, side beam combinations, cross beam combinations and a louver combination, where there are two symmetrically provided side beam combinations and two symmetrically provided cross beam combinations, and the two side beam combinations and the two cross beam combinations are provided vertically; connection assemblies are provided both between the side beam combinations and the stand column combinations and between the cross beam combinations and the stand column combinations, and the side beam combinations and the cross beam combinations are connected to the tops of the stand column combinations by means of the connection assemblies; the louver combination is mounted among the two side beam combinations and the two cross beam combinations, the louver combination is arranged to be replaceable, and the louver combination is also provided with a driving assembly in a mated manner for driving the louver combination to open and close; and the stand column combinations, the side beam combinations and the cross beam combinations are capable of being assembled.

In this embodiment, there are four stand column combinations provided as supports, and the bottoms thereof are used to be connected to the ground or mounting bases; the cross beam combinations and the side beam combinations are mounted together with the stand column combinations by means of the connection assemblies, and the louver combination is mounted and supported by means of the cross beam combinations and the side beam combinations; in addition, the driving assembly is mounted and can be used to drive the louver combination to open and close, thereby adjusting the use angle of the louvers. It should be noted that the stand column combinations, the side beam combinations and the cross beam combinations disclosed in this embodiment are arranged to be capable of being assembled and can be assembled by means of assembly members so as to adjust the size of the louvered shed.

Specifically, the side beam combination above includes a side beam body 9, an upper portion of a side edge of the side beam body 9 is provided with a louver fixing groove 10, a surface of a side edge of the louver fixing groove 10 is provided with a plurality of Z-shaped mounting grooves 11 in a length direction in a linear array manner, a lower portion of the side edge of the louver fixing groove 10 is provided with a snap-fitting groove 12, the bottom of the side beam body 9 extends in a width direction to form a clamping plate 13, and a surface of the clamping plate 13 is provided with a semi-circular buckle groove 14.

Further, the cross beam combination above includes a cross beam body 17, an upper portion of a side edge of the cross beam body 17 is provided with a louver fixing groove 10 identical to that of the side beam body 9, a lower portion of a side edge of the louver fixing groove 10 is provided with a snap-fitting groove 12, the bottom of the cross beam body 17 extends in a width direction to form a clamping plate 13 identical to that of the side beam body 9, and a surface of the clamping plate 13 is provided with a semi-circular buckle groove 14.

Further, the louvered shed further includes a water channel assembly mounted on the cross beam bodies 17 and the side beam bodies 9, where the water channel assembly comprises first water channel bodies 15 and second water channel bodies 18, the first water channel bodies 15 and the second water channel bodies 18 are provided in recessed shapes, the shape of one side edge of the first water channel body 15 and the second water channel body 18 is mated with the shape of the snap-fitting groove 12, the clamping plate 13 and the buckle groove 14, and an upper portion of the other side of the first water channel body 15 and the second water channel body 18 is provided with a light strip mounting groove 16.

In this embodiment, the water channel assembly is provided on the cross beam combinations and the side beam combinations and is configured to drain water on rainy days; the first water channel bodies 15 are mounted on the side beam bodies 9, the second water channel bodies 18 are mounted on the cross beam bodies 17, the first water channel bodies 15 and the second water channel bodies 18 in this embodiment are provided in recessed shapes, the shape of one side edge of the first water channel body and the second water channel body is mated with the shape of the snap-fitting groove 12, the clamping plate 13 and the buckle groove 14, and the upper portion of the other side of the first water channel body 15 and the second water channel body 18 is provided with the light strip mounting groove 16; and the first water channel bodies 15 are snap-fitted on the side beam bodies 9 by means of the snap-fitting grooves 12, the second water channel bodies 18 are snap-fitted on the cross beam bodies 17 by means of the snap-fitting grooves 12, then the first water channel bodies 15 are buckled on the side beam bodies 9 by means of the buckle grooves 14, and the second water channel bodies 18 are buckled on the cross beam bodies 17 by means of the buckle grooves 14.

Preferably, the louver combination includes single-layer louvers 105 provided between the two side beam bodies 9, two ends of the single-layer louver 105 are provided with louver clips 106, the two ends of the single-layer louver 105 are snap-fitted with the louver clips 106, inner sides of the side beam bodies 9 are provided with second threaded holes 104, and the louver clips 106 are in threaded connection with the second threaded holes 104 by means of screws, such that the louver clips 106 are rotatably connected to the side beam bodies 9.

It should be noted that each driving assembly includes a center sill body 101 fixedly mounted between the two cross beam bodies 17, two sides of the center sill body 101 are provided with second linkage rods 110, the first louver is a fixed louver, the clips corresponding to the fixed louver are fixed louver clips 107, the bottom of the fixed louver clip 107 is provided with a connection column 109, one end of the second linkage rod 110 is connected to a surface of the connection column 109, two ends of the center sill body 101 are provided with first positioning holes 102, and second positioning holes 103 are formed in surfaces of the cross beam bodies 17 and located at positions corresponding to the first positioning holes 102.

In this embodiment, the driving assemblies are provided so as to provide power for the louver combination and are configured to adjust the use angle of the louver combination. It should be noted that in this embodiment, after the center sill body 101 is additionally mounted, the first louver is the fixed louver, the clips on the louver are fixed louver clips 107, and the louver combination is driven by the driving assemblies to rotate so as to adjust the angle of the louver combination; and in this embodiment, the louver combination is provided on two sides of the center sill body 101, one driving assembly is mounted on each of the two sides of the center sill body 101, and the driving assemblies are configured to drive the louver combination on the two sides of the center sill body 101 respectively.

In addition, the stand column combination above includes a stand column body 1, the stand column body 1 is arranged in a hollow square pipe shape, a surface of the top end thereof is cut downwards to form a mounting opening 6, and each of the planes on two sides of the mounting opening 6 is provided with three mounting holes 7 in a linear vertical array; a stand column base plate 2 is provided below the stand column body 1, the stand column base plate 2 is arranged in a square shape, a surface thereof is subjected to laser cutting and bent to be provided with four connection plates 3 in a circular central array, and a surface of the connection plate 3 is provided with a first threaded hole 4; and first through holes 5 are provided in four outer surfaces of a lower portion of the stand column body 1 at positions corresponding to the first threaded holes 4, positioning wires 8 are provided outside the stand column body 1, and one end of the positioning wire 8 penetrates through the first through hole 5 and extends into an inner cavity of the stand column body 1 to be in threaded connection with an inner wall of the first threaded hole 4.

Specifically, when each stand column body 1 is mounted on the ground or the mounting base, firstly, a user can place the bottom of the stand column base plate 2 on the mounting base and then tighten and fix the stand column base plate by means of screws, and then the user can insert the bottom of the stand column body 1 on the connection plates 3 and tighten the positioning wires 8 to lock and fix the stand column body 1 and the connection plates 3 together, thereby mounting and fixing the stand column body 1 in the use position.

In order to mount the cross beam combinations and the side beam combinations on the stand column combinations, the connection assemblies are provided at the junctions thereof. Specifically, the connection assembly includes a stand column connector 19 provided at the top end of the stand column body 1, the shape of the stand column connector 19 is identical to that of the top end of the stand column body 1, and second through holes 20 are formed in the positions of two sides of the stand column connector 19 corresponding to the mounting holes 7 on the two sides of the stand column body 1; two ends of the cross beam body 17 and the side beam body 9 are provided with connection blocks 21, the connection blocks 21 are of hollowed-out structures, surfaces of the connection blocks 21 are mated with inner cavities of the cross beam bodies 17 and the side beam bodies 9, top ends and side surfaces of the connection blocks 21 are provided with limiting holes 22, and third through holes 23 are provided in the positions of the connection blocks 21 corresponding to the second through holes 20; fourth through holes 24 are formed in the positions of top ends and side portions of the side beam bodies 9 and the cross beam bodies 17 corresponding to the limiting holes 22; bolts 26 and nuts 27 are further included, and the connection blocks 21 are bolted and fixed to the top ends of the stand column bodies 1 by means of the bolts 26 and the nuts 27; and stand column cover plates 38 connected to the tops of the side beam bodies 9 and the cross beam bodies 17 are further included.

When the cross beam combinations and the side beam combinations are mounted on the stand column bodies 1, the user can limit the connection blocks 21 in the inner cavities of the side beam bodies 9 or the cross beam bodies 17 by passing the screws through the fourth through holes 24 to be in threaded connection in threaded rivets. Then the bolts 26 pass through the three third through holes 23 in each connection block 21, and the nuts 27 fix the bolts 26 in the three third through holes 23 in the connection block 21; the connection blocks 21 connected by means of the bolts 26 are placed into the inner cavities of the cross beam bodies 17 and the side beam bodies 9, the screws pass through the fourth through holes 24 in the cross beam bodies 17 and the side beam bodies 9 to connect the connection blocks 21 into the inner cavities of the cross beam bodies 17 and the side beam bodies 9 in a threaded manner. With regard to the cross beam bodies 17 and the side beam bodies 9 which are connected, the bolts 26 pass through the mounting holes 7 on two sides of the stand column bodies 1 and the second through holes 20 on two sides of the stand column connectors 19, then the side beam bodies 9 and the cross beam bodies 17 are fixedly connected to the stand column bodies 1 by means of the nuts 27, and the four stand column bodies 1 are connected with the same method.

Finally, it should be noted that the above description is only for illustrating the preferred embodiments of the present invention, and is not intended to limit the present invention; although the present invention is illustrated in detail with reference to the above-mentioned embodiments, those skill in the art can still amend the technical solutions recited in the above-mentioned embodiments, or perform equivalent substitutions on part of the technical features thereof, and any modification, equivalent substitution, improvement, etc. made within the spirit and principles of the present invention should fall within the scope of protection of the present invention.

What is claimed is:

1. A louvered shed, comprising stand column combinations, side beam combinations, cross beam combinations and a louver combination, wherein there are two symmetrically provided side beam combinations and two symmetrically provided cross beam combinations, and the two side beam combinations and the two cross beam combinations are provided vertically;

connection assemblies are provided both between the side beam combinations and the stand column combinations and between the cross beam combinations and the stand column combinations, and the side beam combinations and the cross beam combinations are connected to tops of the stand column combinations by means of the connection assemblies;

the louver combination is mounted among the two side beam combinations and the two cross beam combinations, the louver combination is arranged to be replaceable, and the louver combination is also mounted with a driving assembly in a mated manner for driving the louver combination to open and close; and the stand column combinations, the side beam combinations and the cross beam combinations are all arranged to be capable of being assembled;

wherein the side beam combination comprises a side beam body (9), an upper portion of a side edge of the side beam body (9) is provided with a louver fixing groove (10), a surface of a side edge of the louver fixing groove (10) is provided with a plurality of Z-shaped mounting grooves (11) in a length direction in a linear array manner, a lower portion of the side edge of the louver fixing groove (10) is provided with a snap-fitting groove (12), a bottom of the side beam body (9) extends in a width direction to form a clamping plate (13), and a surface of the clamping plate (13) is provided with a semi-circular buckle groove (14);

wherein each of the cross beam combinations comprises a cross beam body (17), an upper portion of a side edge of the cross beam body (17) is provided with a louver fixing groove (10) identical to the louver fixing groove (10) of the side beam body (9), a lower portion of a side edge of the louver fixing groove (10) is provided with a snap-fitting groove (12), a bottom of the cross beam body (17) extends in a width direction to form a clamping plate (13) identical to the louver fixing groove (10) of the side beam body (9), and a surface of the clamping plate (13) is provided with a semi-circular buckle groove (14) identical to the buckle groove (14) in the side beam body (9) in shape;

wherein the louvered shed further comprises a water channel assembly mounted on the cross beam body (17) and the side beam body (9), wherein the water channel assembly comprises a first water channel body (15) and a second water channel body (18), the first water channel body (15) and the second water channel body (18) are both provided in recessed shapes, shapes of one side edge of the first water channel body (15) and the second water channel body (18) are mated with of the snap-fitting groove (12), the clamping plate (13) and the buckle groove (14), and an upper portion of the other side of the first water channel body (15) and second water channel body (18) is provided with a light strip mounting groove (16).

2. The louvered shed according to claim 1, wherein the louver combination comprises several double-layer louvers (28) provided between two side beam bodies (9), two ends of the double-layer louver (28) are both fixedly connected to louver sealing plates (29) by means of screws, surfaces of the louver sealing plates (29) are both provided with rotating shaft holes (30) and pulley fixing holes (31), a louver transmission shaft (32) is fixedly connected in an inner cavity of the rotating shaft holes (30), a louver fixing shaft pulley (33) is fixedly connected in an inner cavity of the pulley fixing hole (31), and a plurality of louver fixing shaft pulleys (33) are all snap-fitted in inner cavities of corresponding Z-shaped mounting grooves (11).

3. The louvered shed according to claim 2, wherein the louver combination comprises single-layer louvers (105) provided between two side beam bodies (9), two ends of the single-layer louvers (105) are both provided with louver clips (106), the two ends of the single-layer louver (105) are both snap-fitted with the louver clips (106), inner sides of the two side beam bodies (9) are provided with second threaded holes (104), and the louver clips (106) are in threaded connection with the second threaded holes (104) by means of screws, such that the louver clips (106) are rotatably connected to the two side beam bodies (9).

4. The louvered shed according to claim 3, wherein the driving assembly comprises first linkage rods (34), each of the first linkage rods (34) is provided with a plurality of connection holes (35) in a length direction in a linear array manner, and the plurality of connection holes (35) are provided in correspondence to the louver transmission shafts (32); and a transmission sheet is mounted on a surface of the louver sealing plate (29), a surface of the transmission sheet is in transmission connection with a driving sheet (36), a gearbox (37) is mounted on a surface of the side beam body (9), and the driving sheet (36) is rotatably connected to the gearbox (37).

5. The louvered shed according to claim 4, wherein the driving assembly comprises a center sill body (101) fixedly mounted between two cross beam bodies (17), two sides of the center sill body (101) are provided with second linkage rods (110), a first louver is a fixed louver, the louver clips corresponding to the fixed louver are fixed louver clips (107), a bottom of the louver clips (107) is provided with a connection column (109), one end of the second linkage rods (110) is connected to a surface of the connection column (109), two ends of the center sill body (101) are provided with first positioning holes (102), and second positioning holes (103) are provided in a surface of the cross beam body (17) and located at positions corresponding to the first positioning holes (102).

6. The louvered shed according to claim 5, wherein the stand column combination comprises a stand column body (1), the stand column body (1) is arranged in a hollow square pipe shape, a surface of a top end thereof is cut downwards to form a mounting opening (6), and planes on two sides of the mounting opening (6) is provided with three mounting holes (7) in a linear vertical array; a stand column base plate (2) is provided below the stand column body (1), the stand column base plate (2) is arranged in a square shape, a surface thereof is subjected to laser cutting and bent to be provided with four connection plates (3) in a circular central array, and a surface of the connection plate (3) is provided with a first threaded hole (4); and first through holes (5) are provided in four outer surfaces of a lower portion of the stand column body (1) at positions corresponding to the first threaded hole (4), positioning wires (8) are provided outside the stand column body (1), and one end of the positioning wire (8) penetrates through the first through hole (5) and extends into an inner cavity of the stand column body (1) to be in threaded connection with an inner wall of the first threaded hole (4).

7. The louvered shed according to claim 6, wherein the connection assembly comprises a stand column connector (19) provided at a top end of the stand column body (1), a shape of the stand column connector (19) is identical to a shape of the top end of the stand column body (1), and second through holes (20) are provided in two sides of the stand column connector (19) at positions corresponding to the three mounting holes (7) in two sides of the stand column body (1); two ends of the two cross beam bodies (17) and the two side beam bodies (9) are provided with connection blocks (21), the connection blocks (21) are arranged in hollowed-out structures, surfaces of the connection blocks (21) are mated with inner cavities of the two cross beam bodies (17) and the two side beam bodies (9), top ends and side surfaces of the connection blocks (21) are provided with limiting holes (22), and third through holes (23) are provided in the connection blocks (21) at positions corresponding to the second through holes (20);

fourth through holes (24) are provided in top ends and side portions of the two side beam bodies (9) and the two cross beam bodies (17) at positions corresponding to the limiting holes (22);

bolts (26) and nuts (27) are further comprised, and the connection blocks (21) are bolted and fixed to top ends of the stand column bodies (1) by means of the bolts (26) and the nuts (27); and stand column cover plates (38) connected to tops of the two side beam bodies (9) and the two cross beam bodies (17) are further included.

* * * * *